US008126156B2

(12) United States Patent
Corbett et al.

(10) Patent No.: US 8,126,156 B2
(45) Date of Patent: Feb. 28, 2012

(54) CALIBRATING AT LEAST ONE SYSTEM MICROPHONE

(75) Inventors: Tim Corbett, Corvallis, OR (US); David R Ingalls, Corvallis, OR (US); Lori A Cook, Corvallis, OR (US); Deqing Hu, Corvallis, OR (US); Scott Grasley, Lebanon, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 697 days.

(21) Appl. No.: 12/326,269

(22) Filed: Dec. 2, 2008

(65) Prior Publication Data

US 2010/0135501 A1 Jun. 3, 2010

(51) Int. Cl.
*H04R 29/00* (2006.01)

(52) U.S. Cl. ..... 381/58; 381/59; 381/107; 381/66; 381/74; 381/92; 381/63; 381/314

(58) Field of Classification Search ..... 381/58, 381/59, 107, 66, 74, 92, 63, 314
See application file for complete search history.

(56) References Cited

U.S. PATENT DOCUMENTS

| | | | | |
|---|---|---|---|---|
| 5,844,994 | A | 12/1998 | Graumann | |
| 6,760,451 | B1 * | 7/2004 | Craven et al. | 381/98 |
| 7,130,705 | B2 * | 10/2006 | Amir et al. | 700/94 |
| 7,203,323 | B2 | 4/2007 | Tashev | |
| 2002/0067835 | A1 * | 6/2002 | Vatter | 381/58 |
| 2002/0154785 | A1 * | 10/2002 | Pedersen | 381/59 |
| 2004/0247136 | A1 * | 12/2004 | Wallace | 381/56 |
| 2005/0254662 | A1 | 11/2005 | Blank | |
| 2006/0032357 | A1 | 2/2006 | Roovers | |
| 2006/0083389 | A1 | 4/2006 | Oxford | |
| 2006/0153391 | A1 * | 7/2006 | Hooley et al. | 381/17 |
| 2008/0071861 | A1 * | 3/2008 | Ingalls et al. | 709/204 |
| 2010/0046767 | A1 * | 2/2010 | Bayley et al. | 381/59 |
| 2010/0272270 | A1 * | 10/2010 | Chaikin et al. | 381/59 |
| 2010/0329490 | A1 * | 12/2010 | Van Schijndel et al. | 381/314 |
| 2011/0051953 | A1 * | 3/2011 | Makinen et al. | 381/92 |

FOREIGN PATENT DOCUMENTS

WO 2007028094 A2 8/2007

* cited by examiner

*Primary Examiner* — A O Williams
(74) *Attorney, Agent, or Firm* — Chun-Liang Kuo

(57) ABSTRACT

A system including at least one system microphone, a processor connected to computer readable memory and the at least one system microphone, a measurement microphone connected to the processor, at least one audio speaker, a signal generator connected to the processor and configured to produce signals from the at least one audio speaker for both the measurement microphone and the at least one system microphone to measure the response of the at least one audio speaker, and a device manager application executable from the computer readable memory and configured to perform the steps of calibrating the at least one audio speaker with the measurement microphone using the signals of the signal generator based on the response of the at least one audio speaker thereby creating at least one calibrated audio speaker and calibrating the at least one system microphone with the at least one calibrated audio speaker using the signals of the signal generator.

20 Claims, 7 Drawing Sheets

CALIBRATING AT LEAST ONE SYSTEM MICROPHONE

BACKGROUND

The high quality audio calibration of at least one system microphone in a remote teleconference environment conventionally involves a trained technician being present in the teleconference environment to calibrate at least one audio speaker and at least one system microphone. The technician often manually performs maintenance on at least one system microphone in the teleconference environment by adjusting the audio component settings of each device, one by one, inside the teleconference environment until the settings reach a level that is optimal to the users of the environment for a teleconference.

Furthermore, the technician frequently returns to the teleconference environment to perform subsequent calibrations to insure that at least one system microphone in the teleconference environment continues to perform according to optimal standards after subsequent uses.

BRIEF DESCRIPTION OF THE DRAWINGS

Various features and advantages of the invention will be apparent from the detailed description which follows, taken in conjunction with the accompanying drawings, which together illustrate, by way of example, features of the invention and wherein.

DETAILED DESCRIPTION

The present invention differs from previous approaches by utilizing a measurement microphone when automatically calibrating at least one system microphone in a teleconference environment. A common practice for conventional teleconference environment calibration is having a technician be physically present to utilize a SPL meter and manually adjust the gain of at least one audio speaker and at least one system microphone to reach a calibrated setting. As a result, a user may find that extraneous funds, time, and resources are wasted and down time is increased in waiting for the technician to arrive and to manually calibrate at least one system microphone in the teleconference environment. In addition, the entity maintaining the teleconference environment may find that funds are increased and time lost when the technician travels to another location to manually calibrate at least one system microphone in a teleconference environment. The present invention alleviates many of the burdens of the user and entity, yet continues to maintain a high quality teleconference environment by utilizing a high quality measurement microphone in the automatic and remote calibration of at least one system microphone in a teleconference environment.

Figure 1:
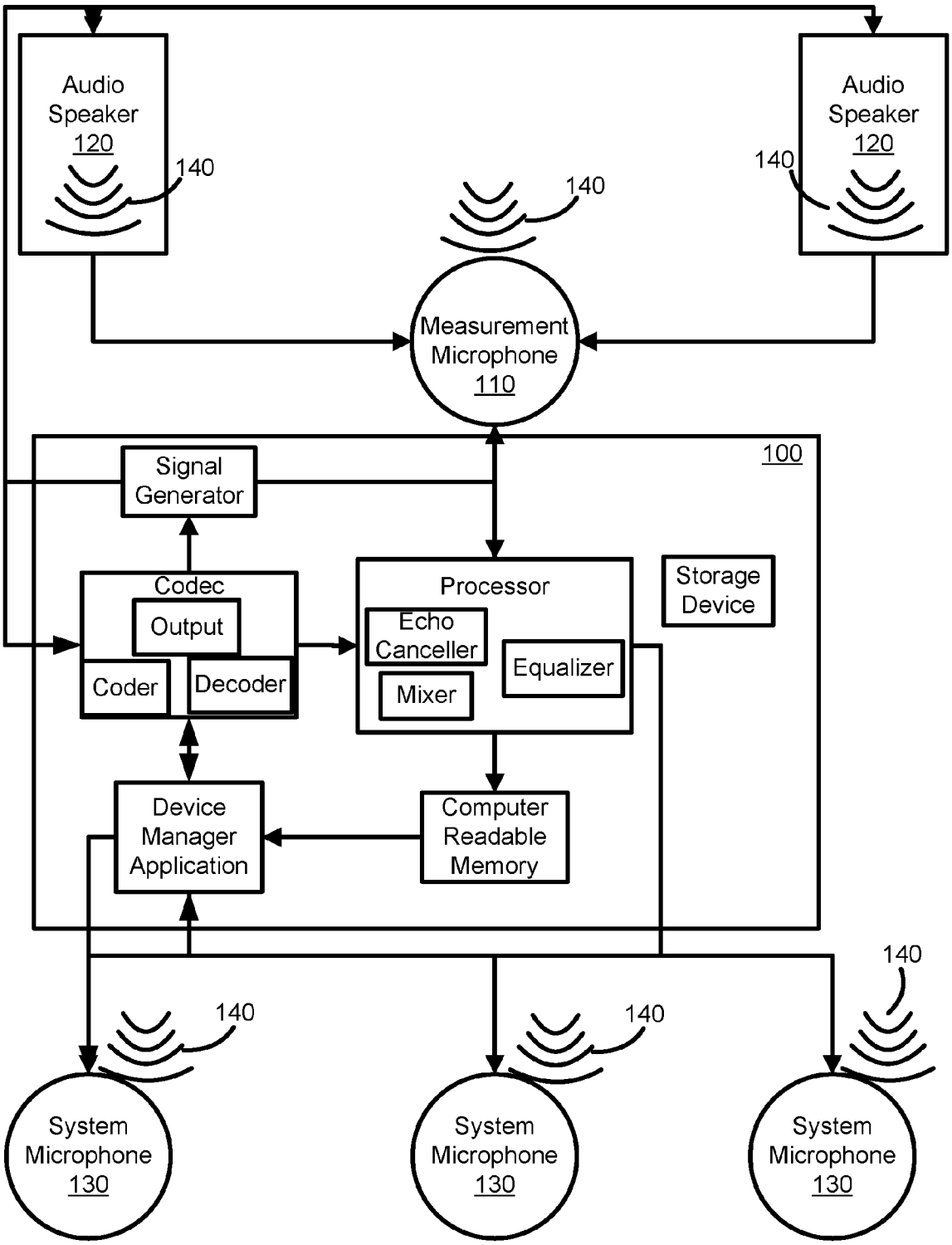
FIG. 1 illustrates a system being connected to at least one audio speaker, at least one system microphone, and a measurement microphone according to an embodiment of the invention.

FIG. 1 illustrates a system being connected to at least one audio speaker, at least one system microphone, and a measurement microphone according to an embodiment of the invention. As illustrated in FIG. 1, the system may includes a processor, a signal generator connected to the processor, a codec, a storage device, computer readable memory connected to the processor, and a device manager application executable from the computer readable memory. The system may include additional devices and components and may be attached or connected to additional devices or components in addition to and/or in lieu of those depicted in FIG. 1.

As illustrated in FIG. 1, at least one audio speaker 120 may be connected to a system 100. At least one audio speaker 120 is an acoustic device which may be housed in a cabinet. At least one audio speaker 120 may be connected to an audio system or another system, such as a computer system and may emit at lest one signal 140 from a signal generator that may be audible to the human ear, measured by a measurement microphone 110, and measured by at least one system microphone 130. Further, at least one audio speaker 120 may be detachable and connected to the system 100 in different locations around the system 100 or at least one audio speaker 120 may be integrated into the system 100. At least one audio speaker 120 may be prompted by the system 100 or a device manager application within the system 100 to output at least one signal 140 from the signal generator in the form of speech, music, or signals for the measurement microphone 110 and at least one system microphone 130 to measure. In addition, at least one audio speaker 120 may be calibrated using the device manager application and measurements from the measurement microphone 110. At least one audio speaker 120 may perform additional functions and may be used for additional tasks in addition to and/or in lieu of those depicted in FIG. 1 and noted above.

Additionally, as noted above, at least one audio speaker 120 may be utilized to output at least one signal 140 from at least one audio speaker 120. The device manager application may then utilize the measurement microphone 110 to measure the sound pressure level of at least one signal 140. A measurement microphone 110 is a calibrated transducer and is generally made with greater care and quality than conventional microphones. The measurement microphone 110 that may pick up at least one signal 140 or any additional signals from many different directions and measure at least one signal 140 for noise levels, reverberation, echo, and impulse responses. Further, the measurement microphone 110 has higher sensitivity to frequencies than conventional microphones and may come with a calibration certificate. As illustrated in FIG. 1, the measurement microphone 110 may be connected to the processor in the system 100.

Additionally, the measurement microphone 110 may be fixed in a stationary position embedded into the system 100 and may be controlled by the device manager application. In one embodiment, the measurement microphone 110 may be fixed in a horizontal position facing at least one audio speaker 120 and may receive at least one signal 140 that has been outputted from at least one audio speaker 120 with the signal generator connected to the system 100. The measurement microphone 110 may then measure the sound pressure level of at least one signal 140 that has been outputted and transfer the measurement data to the device manager application to measure. Additionally, the measurement microphone 110 may be tested by the device manager application to insure that it conforms with optimal standards. The measurement microphone 110 may perform additional functions and be used for additional tasks in addition to and/or in lieu of those noted above.

Furthermore, as illustrated in FIG. 1, the system 100 may be connected to at least one system microphone 130. At least one system microphone 130 is an input instrument that modifies electric current from at least one signal 140 and passes it to another device or system 100. At least one system microphone 130 may be connected to the system 100 and may be calibrated using at least one signal 140 outputted from at least one calibrated audio speaker by the device manager application of the system 100. Additionally, at least one system microphone 130 may be used during a teleconference or video conference. At least one system microphone 130 may perform additional functions and be calibrated using additional methods in addition to and/or in lieu of those noted above.

Figure 2:
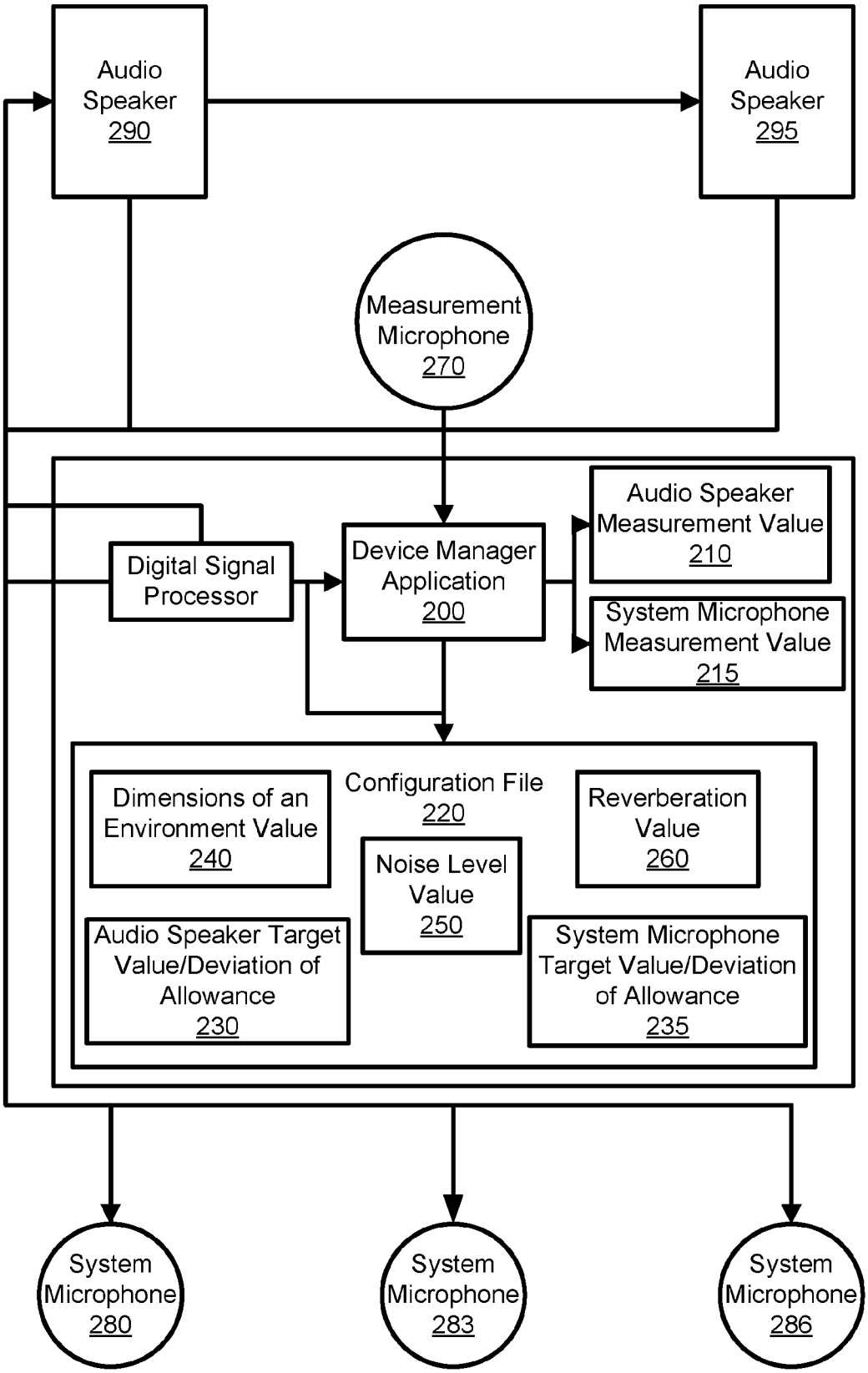
FIG. 2 illustrates a device manager application creating at least one calibrated audio speaker and at least one calibrated system microphone from at least one audio speaker measurement value, at least one system microphone measurement value, and a configuration file according to an embodiment of the invention.

FIG. 2 illustrates a device manager application creating at least one calibrated audio speaker and at least one calibrated system microphone from at least one audio speaker measurement value, at least one system microphone measurement value, and a configuration file according to an embodiment of the invention. A device manager application 200 may be a software based application used by a system to manage the input and output of at least one audio speaker 290, any additional audio speakers 295, at least one system microphone 280, any additional system microphones 283, 286, and a measurement microphone 270. The device manager application 200 may be stored locally on the system or remotely other locations and utilizing different storing means in addition to and/or in lieu of those depicted in FIG. 2 and noted above.

The device manager application 200 may create at least one calibrated audio speaker with the measurement microphone 270, using at least one signal from a signal generator in the system based on the response of at least one audio speaker 290, and may create at least one calibrated system microphone with at least one signal of the signal generator outputted from the calibrated audio speaker. Additionally, the device manager application 200 may store and record decibel values, scan at least one signal for reverberation, echo, frequency spikes, frequency responses, and impulse responses and utilize the results to create at least one noise level value 250, at least one reverberation value 260, and at least one dimensions of an environment value 240. At least one dimensions of an environment value may be a dimensions of a room and/or an area of the room, indicating the size of the room. Additionally, the device manager application 200 may also perform an initial conformity test on the measurement microphone 270 to insure that the measurement microphone 270 is functioning correctly and continue to monitor and calibrate the gain of at least one audio speaker 290 and the gain of at least one system microphone 280 in response to the measurement microphone measuring 270 continuing to measure at least one signal from at least one audio speaker 290 during a teleconference.

As noted above, the device manager application 200 may also perform an initial conformity test on the measurement microphone 270 to insure that the measurement microphone 270 is functioning correctly. In performing the initial conformity test on the measurement microphone 270, the device manager application 200 may examine a calibration history of at least one audio speaker 290 and at least one system microphone 280. Additionally, the device manager application 200 may examine a calibration history of any additional audio speakers 295 and/or any additional system microphones 283, 286. In one embodiment, the device manager application 200 may determine whether a number of calibrations and a frequency of calibrations on at least one audio speaker 290 and at least one system microphone 280 from the calibration history exceed a calibration number threshold value and a calibration frequency threshold value. Additionally, the device manager application 200 may determine whether a number of calibrations and frequency of calibrations for any additional audio speakers 295 and any additional system microphones 283, 286 exceed each corresponding calibration number threshold value and each corresponding calibration frequency threshold value. A calibration number threshold value and a calibration frequency threshold value may be previously defined by a user or the system. If the number and/or frequency of calibrations for at least one audio speaker 290, any additional audio speakers 295, at least one system microphone 280 and/or any additional system microphone 283, 286 individually or conjunctively exceed a threshold value, the device manager application 200 may determine that the measurement microphone 270 has failed the initial conformity test. If the measurement microphone 270 has failed the initial conformity test, the measurement microphone 270 may need to be replaced or have maintenance performed on it.

If the number and/or frequency of calibrations for at least one audio speaker 290, any additional audio speakers 295, at least one system microphone 280, and any additional system microphones 283, 286 individually or conjunctively do not exceed a threshold value, the device manager application 200 may determine that the measurement microphone 270 has passed the initial conformity test and proceed to create at least one calibrated audio speaker, any additional calibrated audio speakers, at least one calibrated system microphone, and any additional calibrated system microphone.

In one embodiment, the device manager application 200 may access at least one configuration file 220 to create at least one calibrated audio speaker 290, any additional calibrated audio speakers 295, at least one calibrated system microphone 280, and any/or additional calibrated system microphones 283, 286 utilizing at least one audio speaker measurement value 210 and at least one system microphone measurement value 215. In another embodiment, the device manager application 200 may access at least one configuration file 220 to further calibrate at least one audio speaker 290, any additional audio speakers 295, at least one system microphone 280, and any additional system microphones 283, 286 utilizing a dimensions of an environment value 240, a noise level value 250, a reverberation value 260 stored on at least one configuration file 220, at least one audio speaker target value and a deviation of a allowance 230, and/or at least one system microphone target value and a deviation of allowance 235.

A configuration file 220 is a data file, accessible by a processor and the device manager application 200, which includes data, such as at least one audio speaker target value and a deviation of allowance 230 and at least one system microphone target value and a deviation of allowance 235. Additionally, as noted above, the configuration file 220 may further include a noise level value 250, a reverberation value 260, and/or a dimensions of an environment value 240. The configuration file 20 may be stored locally the system or remotely on a database and may be used by the device manager application 200 in the calibration of at least one audio speaker 290, any additional audio speakers 295, at least one system microphone 280, and any additional system microphones 283, 286.

In the creation of at least one calibrated audio speaker 290 and at least one calibrated system microphone 280, the device manager application 200 may create and store at least one audio speaker measurement value 210 for at least one audio speaker 290 using the measurement microphone 270. An audio speaker measurement value 210 is a decibel measurement of at least one signal that is generated by a signal generator and outputted through at least one audio speaker 290.

The device manager application 200 may initially send an instruction to output at least one signal from at least one audio speaker 290. The device manager application 200 may then utilize the measurement microphone 270 to measure a sound pressure level of at least one signal and create at least one audio speaker measurement value 210. Additionally, the device manager application 200 may choose to output any additional signals and create any additional audio speaker measurement values for any additional audio speakers 295. As illustrated in FIG. 2, the device manager application 200 may then compare at least one audio speaker measurement value 210 to at least one audio speaker target value 230 and a deviation of allowance on the configuration file 220. The device manager application 200 may then create at least one calibrated audio speaker by adjusting and calibrating the gain of at least one audio speaker 290 to meet at least one audio speaker target value 230 and a deviation of allowance. In calibrating the gain of at least one audio speaker 290 to meet at least one audio speaker target value, the device manager may adjust a phase delay and/or a frequency spectrum of at least one audio speaker 190. The device manager may adjust additional values and/or elements in addition to and/or in lieu of those illustrated in FIG. 2 and noted above in calibrating the gain of at least one audio speaker 290.

In one embodiment, the device manager application 200 may read at least one audio speaker target value 230 in the configuration file 220 and find that the value is normalized. The device manager application 200 may then create at least one calibrated audio speaker by normalizing the gain of at least one audio speaker 290 to meet the normalized gain specified on at least one audio speaker target value 230 and the deviation of allowance. In another embodiment, the device manager application 200 may create at least one calibrated audio speaker by adjusting and calibrating the gain of at least one audio speaker 290 further in response to at least one noise level value 250, at least one reverberation value 260, and/or at least one dimensions of an environment value 240. Additionally, the device manager application 200 may create at least one calibrated audio speaker by adjusting and calibrating the gain of at least one audio speaker 290 further in response to a size of the environment, a number of audio speakers, a number of system microphones, a number of users, and a position of each user. The device manager application 200 may then move onto any additional audio speakers 295 and continue to create any additional calibrated audio speakers with any additional audio speaker measurement values by utilizing the above method to calibrate any additional audio speakers.

In addition, as illustrated in FIG. 2, the device manager application 200 may create at least one calibrated system microphone and any additional calibrated system microphones. The device manager application 200 may initially create and store at least one system microphone measurement value 215 for at least one system microphone 280 and any additional system microphones 283, 286 using the measurement microphone 270. A system microphone measurement value 215 is a decibel measurement of at least one signal that is generated by the signal generator and outputted through at least one calibrated audio speaker and/or any additional calibrated speakers.

In one embodiment, the device manager application 200 may initially choose to calibrate at least one system microphone 280 by un-muting at least one system microphone 280, while muting any additional system microphones 283 and 286. The device manager application 200 may then send an instruction to output at least one signal from at least one calibrated audio speaker and/or any additional calibrated audio speakers. Additionally, the device manager application 200 may send an instruction for at least one system microphone 280 to measure a sound pressure level of at least one signal and transfer the data to the device manager application 200. The device manager application 200 may then create at least one system microphone measurement value 215 for at least one system microphone 280. Additionally, the device manager application 200 may choose to output any additional signals and create any additional system microphone measurement values for any additional system microphones.

As illustrated in FIG. 2, the device manager application 200 may then create at least one calibrated system microphone by comparing at least one system microphone measurement value 215 to at least one system microphone target value 235 and a deviation of allowance on the configuration file 220 by adjusting and calibrating the gain of at least one system microphone 280 to meet at least one system microphone target value 235 and a deviation of allowance. When creating at least one calibrated system microphone by adjusting and calibrating the gain of at least one system microphone 280, the device manager application 200 may consider a deviation of allowance for at least one system microphone target value. In one embodiment, the device manager application 200 may read at least one system microphone target value 235 in the configuration file 220 and find that the value is normalized. The device manager application 200 may then proceed to create at least one calibrated system microphone by normalizing the gain of at least one system microphone to meet the normalized gain specified on at least one system microphone target value 235 and a deviation of allowance.

In another embodiment, the device manager application 200 may calibrate the gain of at least one system microphone 280 by adjusting and calibrating the gain of at least one system microphone 280 further in response to at least one noise level value 250, at least one reverberation value 260, and/or at least one dimensions of an environment value 240. Additionally, the device manager application 200 may calibrate the gain of at least one system microphone 280 by adjusting and calibrating the gain of at least one system microphone 280 further in response to a size of the environment, a number of audio speakers, a number of system microphones, a number of users, and a position of each user. The device manager application 200 may then move onto any additional system microphones 283, 286 and continue to create any additional calibrated system microphones with any additional audio speaker measurement values by utilizing the above method to calibrate any additional system microphones 283, 286. The device manager application 200 may utilize additional methods, create additional values, and take into consideration additional factors when creating at least one calibrated audio speaker, any additional calibrated audio speakers, at least one calibrated system microphone, and/or any additional calibrated system microphones.

Figure 3:
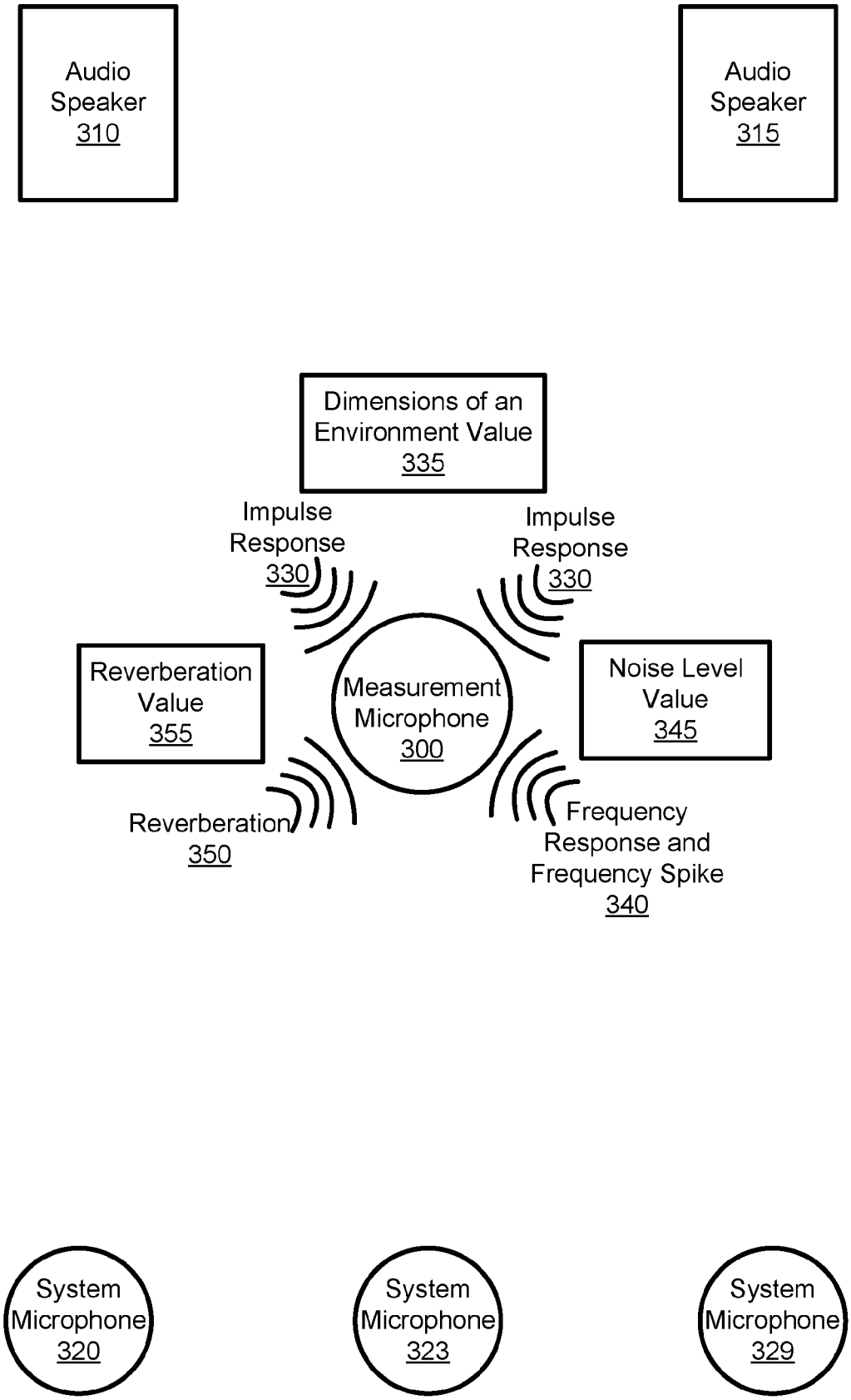
FIG. 3 illustrates a measurement microphone measuring at least one signal from at least one audio speaker according to an embodiment of the invention.

FIG. 3 illustrates a measurement microphone measuring at least one signal from at least one audio speaker according to an embodiment of the invention. As noted above, a device manager application may create at least one calibrated audio speaker with a measurement microphone 300, using at least one signal from a signal generator based on the response of at least one audio speaker 310, and may create at least one calibrated system microphone 320 with at least one signal from the signal generator outputted from the calibrated audio speaker. Additionally, as noted above, the device manager application may determine at least one noise level value 345, at least one reverberation value 355, and at least one dimensions of an environment value 335. The device manager application may create at least one calibrated audio speaker and at least one calibrated system microphone 320 by further adjust and calibrating a gain of at least one audio speaker 310 and a gain of at least one system microphone to match at least one noise level value, at least one reverberation value, and at least one dimensions of an environment value in a configuration file.

As illustrated in FIG. 3, in determining at least one noise level 345, the device manager application may utilize the measurement microphone 300 to scan at least one signal for a frequency response and a frequency spike 340. Additionally, in determining at least one reverberation value 355, the device manager application may utilize the measurement microphone 300 to scan at least one signal for a reverberation 350 to determine an amount of echo in the environment. Further, in determining at least one dimensions of an environment value 335, the device manager application may measure at least one impulse response 330 from at least one signal from signal generator. The device manager application may additionally instruct at least one audio speaker 310 to output at least one signal in at least one direction and calculate the strength of the impulse response 330 and the amount of time for the signal to return within the environment to the measurement microphone 300. The measurement microphone 300 may be utilized to measure additional signals from at least one audio speaker 310 and/or any additional audio speakers to create any additional values in addition to and/or in lieu of those depicted in FIG. 3 and noted above.

Figure 4:
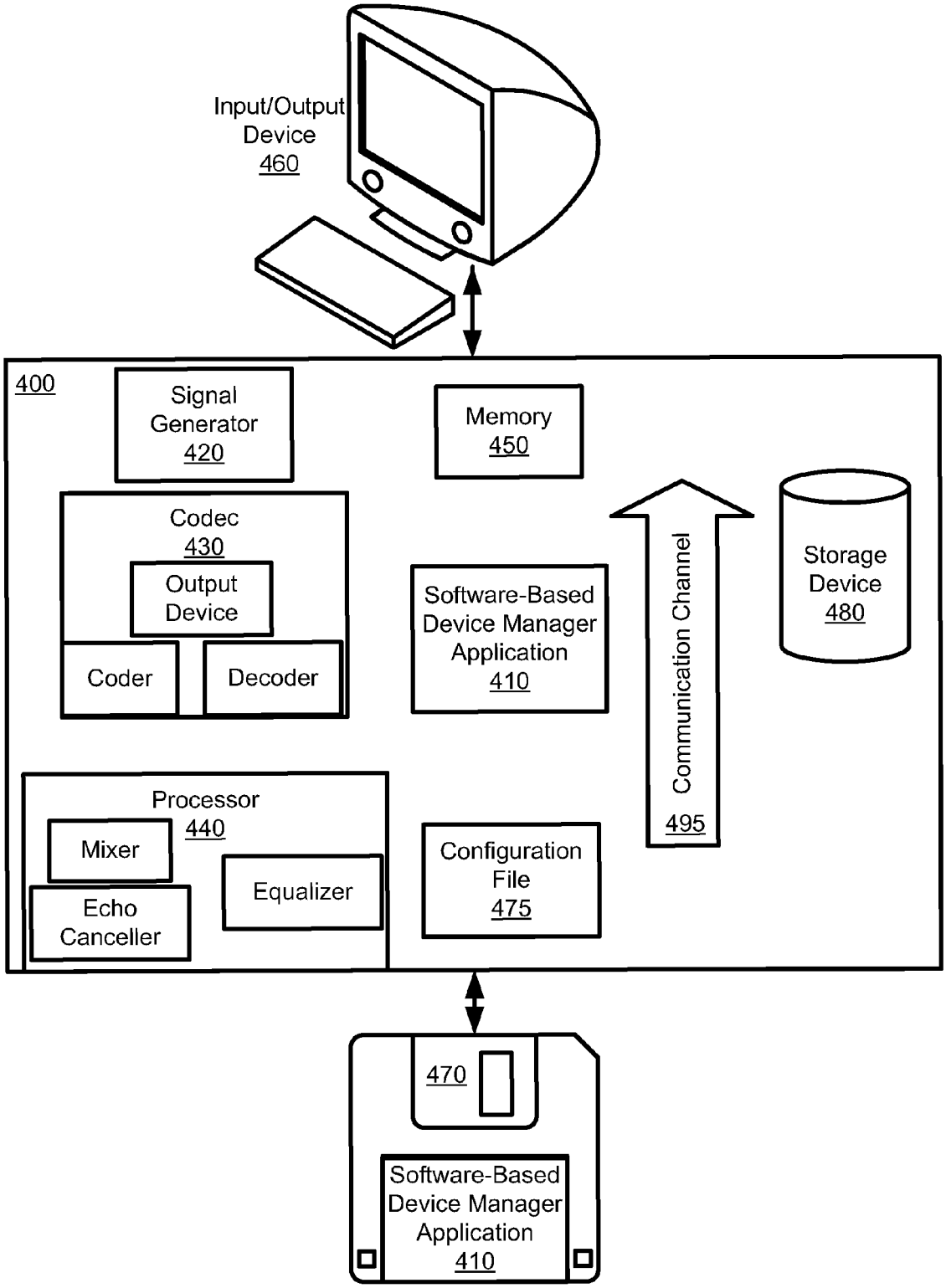
FIG. 4 illustrates a system, components of the system, subcomponents of the system, and a software-based device manager application stored on a removable medium being accessed by a system according to an embodiment of the invention.

FIG. 4 illustrates a system, components of the system, subcomponents of the system, and a software-based device manager application stored on a removable medium being accessed by a system according to an embodiment of the invention. As illustrated in FIG. 4, a system 400 may include a signal generator 420, a codec 430, a processor 440, memory 450, a software-based device manager application 410, at least one communication channel 495, an input/output device 460, a storage device 480, and a removable storage medium 470. Further, as illustrated in FIG. 4, the codec 430 may include an output device, a coder, and a decoder. Additionally, the processor 440 may include an echo canceller, a mixer, and an equalizer.

Furthermore, FIG. 4 illustrates that a software-based device manager application 410 may be stored on a removable storage medium 470 being accessed by the system 400 according to an embodiment of the invention. The software-based device manager application 410 may be stored and accessed from a hard drive, a compact disc, a flash disk, a network drive or any other form of computer readable medium. The software-based device manager application 410 may be stored and accessed from additional devices in addition to and/or in lieu of those depicted in FIG. 4.

Additionally, as illustrated in FIG. 4, the system 400 may include a signal generator 420. The signal generator 420 may be a software or hardware component which may create signals of different frequencies. The signal generator 420 may produce at least one signal that is flat or of variable frequency that may be outputted from at least one audio speaker and any additional audio speakers individually or in conjunction for a measurement microphone and/or at least one system microphone and any additional system microphones to measure. Additionally, at least one signal may be used as an audio speaker test signal or a system microphone test signal. Furthermore, as noted above, at least one signal may be outputted in at least one direction and used to scan for a frequency response, reverberation, and impulse response to determine the amount of noise, echo, reverberation, and/or dimensions or size of the environment. The signal generator 420 may produce additional signals and may be used for additional purposes in addition to and/or in lieu of those depicted above.

As noted above, the system 400 may include a codec 430, which may further include an output device, a coder, and a decoder to encode and decode various data streams and/or signals. In addition, the system 400 may also include a processor 440, which may include a mixer, echo canceller, and an equalizer to convert, measure, and filter various signals. Furthermore, the system 400 may include memory 450 that may be read from and/or written to, a device manager application 410 that may be software-based and manage/modify data and settings, an input/output device 460 for another system or user to enter instructions into the system 400 and to display graphical information from the system 400, a storage device 480 for temporary or permanent storage, and one or more communication channels 495 for each component of the system and other systems to utilize when communication or transferring data. The system 400 may include additional components and subcomponents in addition to and/or in lieu of those depicted in FIG. 4.

Reference will now be made to exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the invention as illustrated herein, which would occur to one of ordinary skill within the relevant art and having possession of this disclosure, are to be considered within the scope of the invention.

Figure 5:
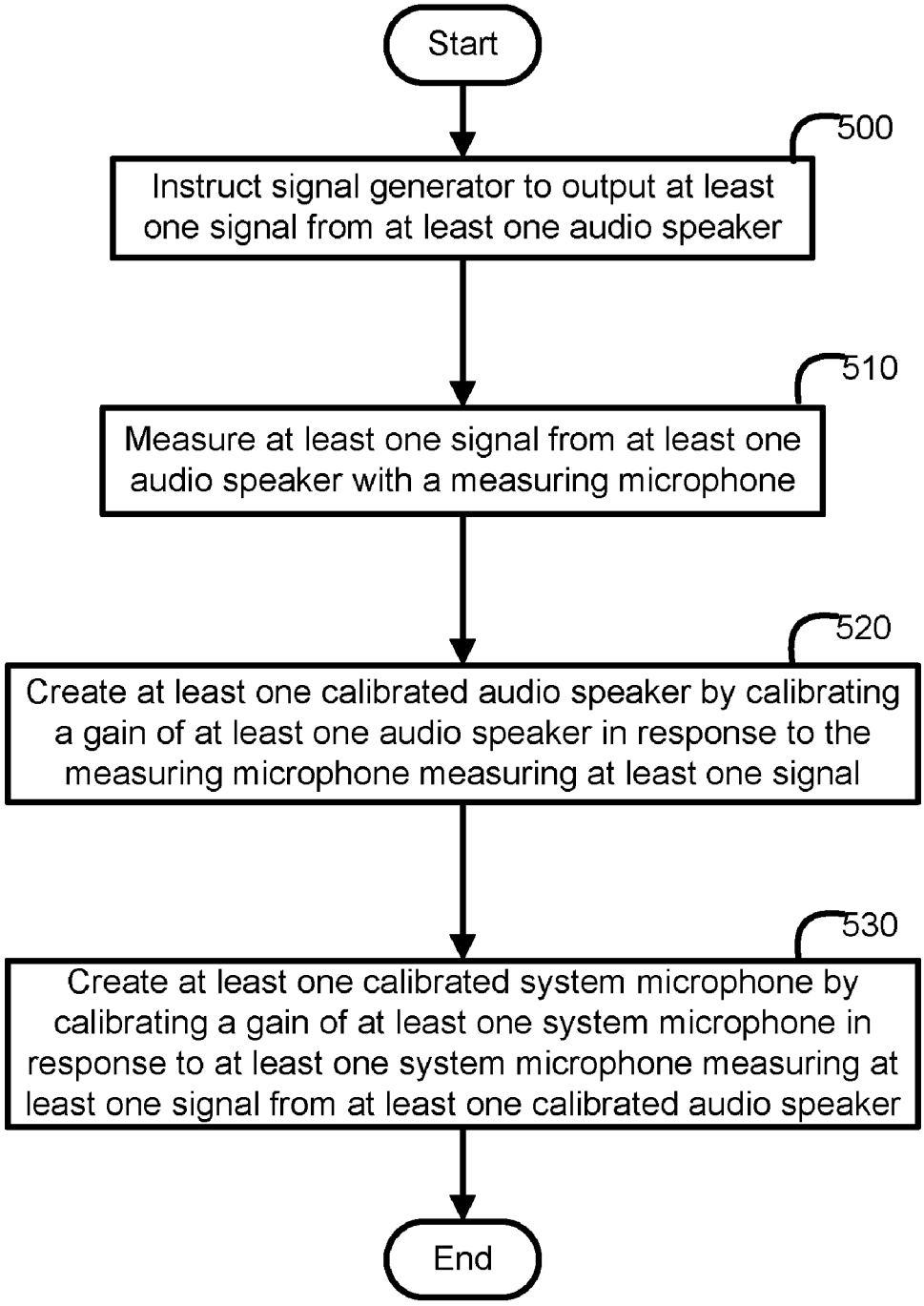
FIG. 5 is a flow chart illustrating a method for automatically creating at least one calibrated system microphone by calibrating at least one system microphone using a measurement microphone according to an embodiment of the invention.

FIG. 5 is a flow chart illustrating a method for automatically creating at least one calibrated system microphone by calibrating at least one system microphone using a measurement microphone according to an embodiment of the invention. The method of FIG. 5 utilizes a device manager application, a measurement microphone, at least one signal, at least one audio speaker, and at least one system microphone. The method of FIG. 5 may utilize additional components are/or devices in addition to and/or in lieu of those depicted in FIG. 5 and noted above.

As noted above, a device manager application may be software-based and may either be launched locally or remotely. The device manager may initially instruct the signal generator to output at least one signal from at least one audio speaker 500. The device manager application may then measure at least one signal from at least one audio speaker with a measuring microphone 510. The device manager application may then proceed to create at least one calibrated audio speaker by calibrating a gain of at least one audio speaker in response to the measuring microphone measuring at least one signal 520. After the device manager application has created at least one calibrated audio speaker, the device manager may then create at least one calibrated system microphone by calibrating a gain of at least one system microphone in response to at least one system microphone measuring at least one signal from at least one calibrated audio speaker 530.

The method for automatically calibrating at least one system microphone using a measurement microphone may then be complete. The system or device manager application may utilize additional methods for automatically calibrating at least one system microphone using a measurement microphone in addition to and/or in lieu of those depicted in FIG. 5.

Figure 6:
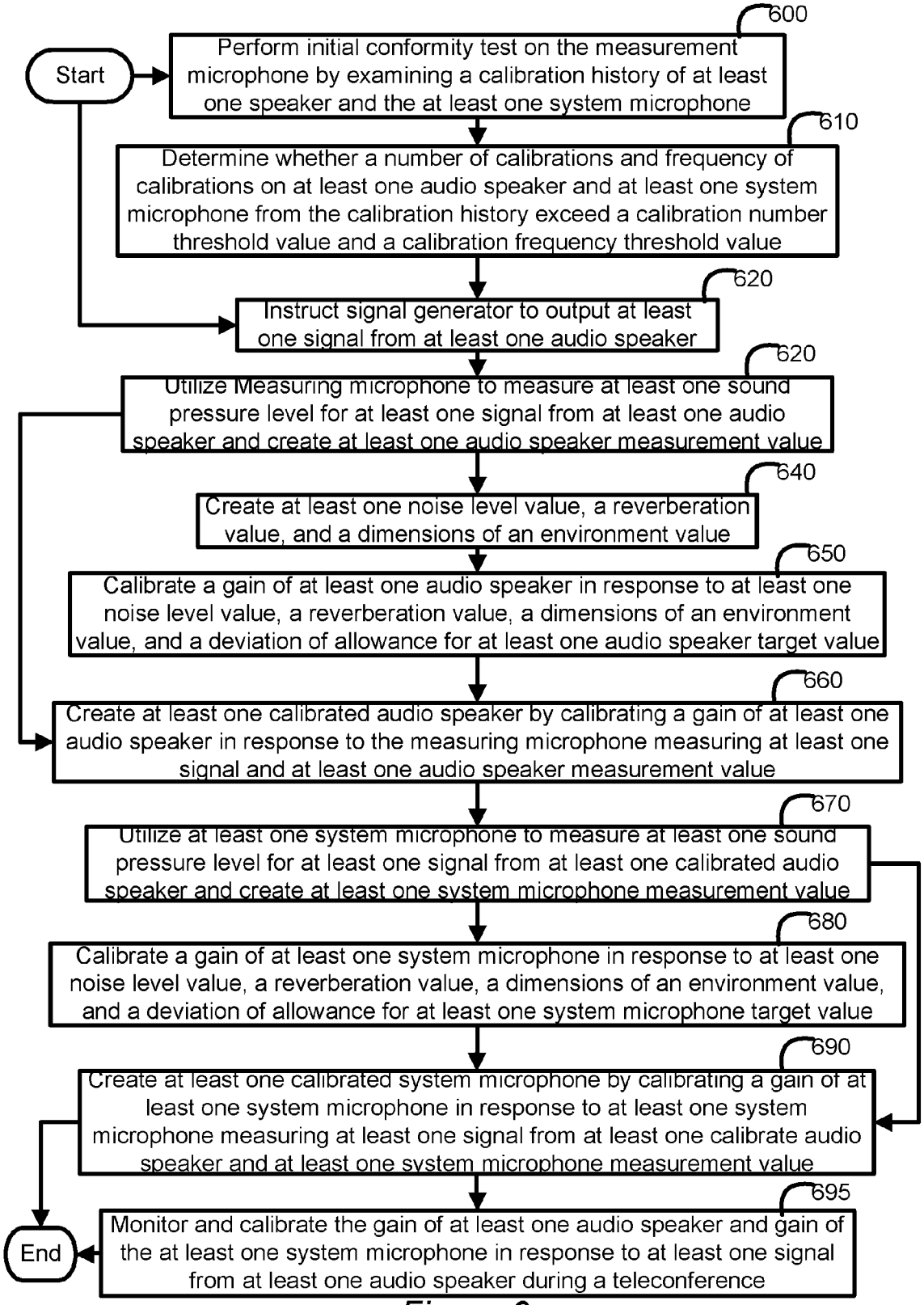
FIG. 6 is a flow chart illustrating a method for initially performing an initial conformity test on a measurement microphone and automatically creating at least one calibrated system microphone by calibrating at least one system microphone using a measurement microphone according to an embodiment of the invention.

FIG. 6 is a flow chart illustrating a method for initially performing an initial conformity test on a measurement microphone and automatically creating at least one calibrated system microphone by calibrating at least one system microphone using a measurement microphone according to an embodiment of the invention. The method of FIG. 6 utilizes a device manager application, a configuration file, a measurement microphone, at least one signal, at least one audio speaker, and at least one system microphone. The method of FIG. 6 may utilize additional components are/or devices in addition to and/or in lieu of those depicted in FIG. 6 and noted above.

A device manager application may initially determine whether to perform an initial conformity test on the measurement microphone by examining a calibration history of at least one speaker and at least one system microphone 600. If an initial conformity test is performed, the device manager application further determines whether a number of calibrations and frequency of calibrations on at least one audio speaker and at least one system microphone from the calibration history exceed a calibration number threshold value and a calibration frequency threshold value 610. As noted above, the calibration number threshold value and the calibration frequency threshold value may be previously defined by a user or a system and the device manager application determines whether the number of calibrations and frequency of calibrations for at least one audio speaker, any additional audio speakers, at least one system microphone, and any additional system microphones exceed each previously defined corresponding calibration number threshold value and each corresponding calibration frequency threshold value.

If the number and/or frequency of calibrations for at least one audio speaker, any additional audio speakers, at least one system microphone, and/or any additional system microphones individually or conjunctively exceed a threshold value, the device manager application may determine that the measurement microphone has failed the initial conformity test and may need to be replaced or have maintenance performed on it. If the number and/or frequency of calibrations for at least one audio speaker, any additional audio speakers, at least one system microphone, and any additional system microphones individually or conjunctively do not exceed a threshold value, the device manager application may determine that the measurement microphone has passed the initial conformity test and proceed to instruct a signal generator to output at least one signal from at least one audio speaker 620.

If the device manager application decides not to perform an initial conformity test on the measurement microphone, the device manager may instruct the signal generator to output at least one signal from at least one audio speaker 620. The device manager application may then utilize the measuring microphone to measure at least one sound pressure level for at least one signal from at least one audio speaker and create at least one audio speaker measurement value 630. In one embodiment, the device manager application may then proceed to create at least one calibrated audio speaker by calibrating a gain of at least one audio speaker in response to the measuring microphone measuring at least one signal and at least one audio speaker measurement value 660.

In another embodiment, the device manage may initially create at least one noise level value, a reverberation value, and a dimensions of an environment value 640. The device manager application may then adjust and calibrate a gain of at least one audio speaker in response to at least one noise level value, a reverberation value, a dimensions of an environment value, and a deviation of allowance for at least one audio speaker target value 650. After the gain of the at least one audio speaker has been calibrated in response to at least one noise level value, a reverberation value, a dimensions of an environment value, and a deviation of allowance for at least one audio speaker target value, the device manager application may proceed to create at least one calibrated audio speaker by further adjusting and calibrating a gain of at least one audio speaker in response to the measuring microphone measuring at least one signal and the at least one audio speaker measurement value 660.

After at least one calibrated audio speaker has been created, the device manager application may then utilize at least one system microphone to measure at least one sound pressure level for at least one signal from at least one calibrated audio speaker and create at least one system microphone measurement value 670. In one embodiment, the device manager application may proceed to create at least one calibrated system microphone by adjusting and calibrating a gain of at least one system microphone in response to at least one system microphone measuring at least one signal from at least one calibrated audio speaker and at least one system microphone measurement value 690. In another embodiment, the device manager application may first adjust and calibrate a gain of at least one system microphone in response to at least one noise level value, a reverberation value, a dimensions of an environment value, and a deviation of allowance for at least one system microphone target value 680. The device manager application may then create at least one calibrated system microphone by further adjusting and calibrating a gain of at least one system microphone in response to at least one system microphone measuring at least one signal from at least one calibrate audio speaker and at least one system microphone measurement value 690.

The method for initially performing an initial conformity test on a measurement microphone and automatically calibrating at least one system microphone using a measurement microphone may then be complete or the device manager application may continue to monitor and calibrate the gain of at least one audio speaker and the gain of at least one system microphone in response to at least one signal from at least one audio speaker during a teleconference. The system or device manager application may utilize additional methods for automatically calibrating at least one system microphone using a measurement microphone in addition to and/or in lieu of those depicted in FIG. 6.

Figure 7:
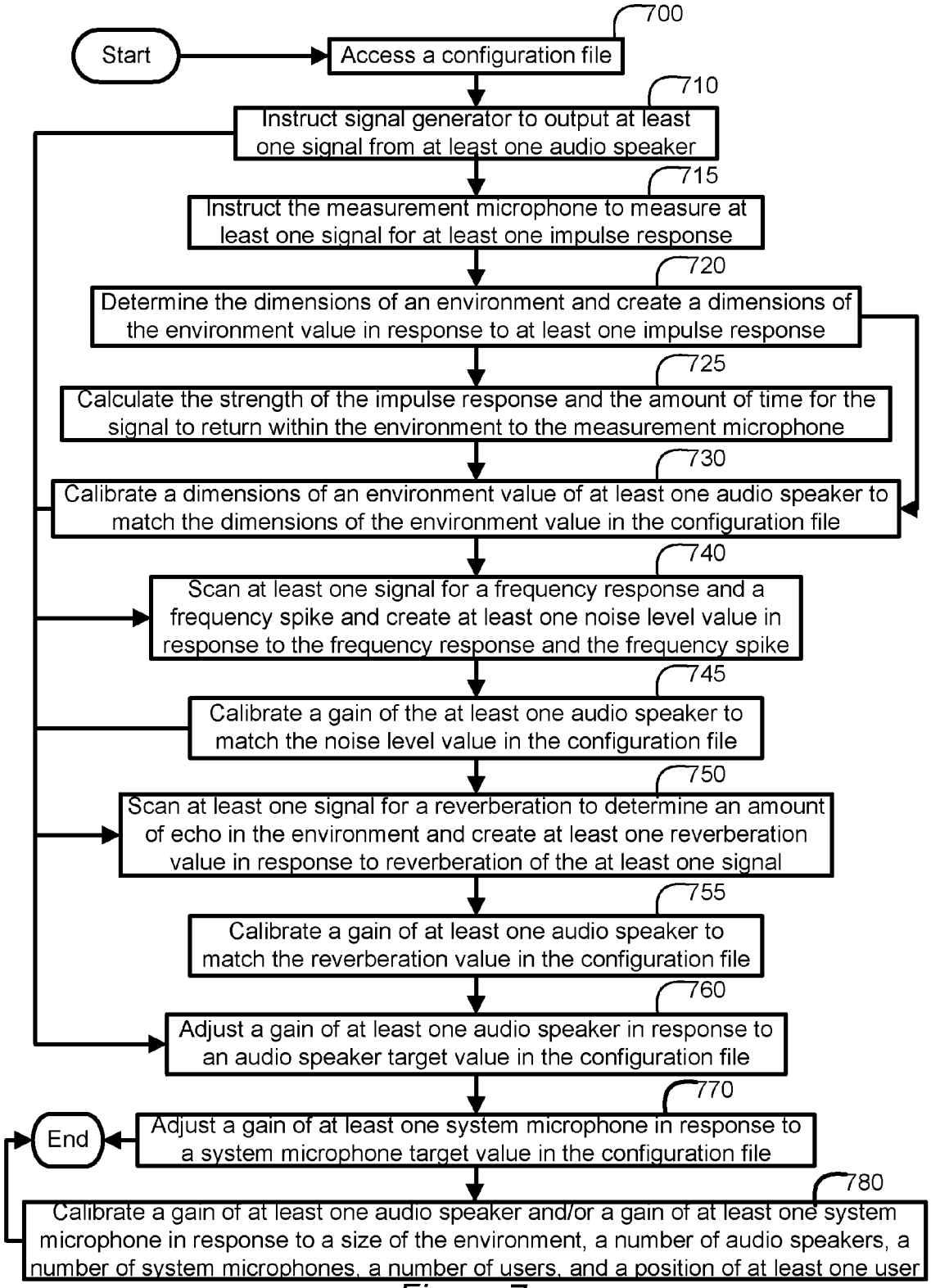
FIG. 7 is a flow chart illustrating a method for automatically calibrating at least one system microphone by adjusting and calibrating a gain of at least one audio speaker and a gain of at least one system microphone in response to at least one signal generated from at least one audio speaker and values from a configuration file according to an embodiment of the invention.

FIG. 7 is a flow chart illustrating a method for automatically calibrating at least one system microphone by adjusting and calibrating a gain of at least one audio speaker and a gain of at least one system microphone in response to at least one signal generated from at least one audio speaker and values from a configuration file according to an embodiment of the invention. The method of FIG. 7 utilizes a configuration file, a device manager, a measurement microphone, at least one audio speaker, and at least one system microphone.

The device manager application may initially access a configuration file 700. As noted above, the configuration file may include existing data, such as at least one audio speaker target value, at least one system microphone target value, a noise level value, a reverberation value, a dimensions of an environment value, a deviation of allowance for at least one audio speaker, and a deviation of allowance for at least one system microphone.

The device manager application may then instruct a signal generator to output at least one signal from at least one audio speaker 710. As noted above, at least one signal may be outputted in at least one direction and used to scan for a frequency response, reverberation, and impulse response to determine the amount of noise, echo, reverberation, dimensions, and/or size of the environment. The device manager application may then utilized the measurement microphone to measure at least one signal and create at least one dimensions of the environment value, at least one noise level, and/or at least one reverberation value to calibrate a gain or a dimensions of the environment value of at least one audio speaker.

In creating at least one dimensions of the environment value, the device manager may initially instruct the measurement microphone to measure at least one signal for at least one impulse response 715. The device manager application may then determine the dimensions of an environment and create a dimensions of the environment value in response to at least one impulse response 720 by calculating the strength of the impulse response and the amount of time for at least one signal to return within the environment to the measurement microphone 725. The device manager application may next proceed to adjust and calibrate a dimensions of an environment value of at least one audio speaker to match the dimensions of the environment value in the configuration file 730.

Additionally, in creating at least one noise level value, the device manager application may utilize the measurement microphone to scan at least one signal for a frequency response and a frequency spike and proceed to create at least one noise level value in response to the frequency response and the frequency spike 740. The device manager application may then proceed to utilize at least one noise level measured to adjust and calibrate a gain of at least one audio speaker to match the noise level value in the configuration file 745.

Further, in creating at least one reverberation value, the device manager application may instruct the measurement microphone to scan at least one signal for a reverberation to determine an amount of echo in the environment and create at least one reverberation value in response to the reverberation of at least one signal 750. The device manager application may then proceed to utilize at least one reverberation level measured to adjust and calibrate a gain of at least one audio speaker to match the reverberation value in the configuration file 755.

After adjusting and calibrating a gain or a dimensions of the environment value of at least one of at least one audio speaker in response to at least one dimensions of the environment value, at least one noise level, and/or at least one reverberation value, the device manager application may further calibrate at least one calibrated audio speaker by adjusting and calibrating a gain of at least one audio speaker in response to an audio speaker target value in the configuration file 760. The device manager application may then calibrate at least one system microphone by adjusting and calibrating a gain of at least one system microphone in response to a system microphone target value in the configuration file 770.

The method for automatically calibrating at least one system microphone by adjusting and calibrating a gain of at least one audio speaker and at least one system microphone in response to signals generated from at least one audio speaker and values from the configuration file may then be complete or the device manager application may further adjust and calibrate the gain of at least one audio speaker and/or the gain of at least one system microphone in response to a size of the environment, a number of audio speakers, a number of system microphones, a number of users, and a position of at least one user 780. The system or device manager application may utilize additional methods for automatically calibrating at least one system microphone by adjusting a gain of at least one audio speaker and at least one system microphone in response to signals generated from the at least one audio speaker and values from the configuration file in addition to and/or in lieu of those depicted in FIG. 7.

What is claimed is:

1. A system, comprising:

at least one system microphone;

a processor connected to computer readable memory and the at least one system microphone;

a measurement microphone connected to the processor;

at least one audio speaker;

a signal generator connected to the processor and configured to produce signals from the at least one audio speaker for both the measurement microphone and the at least one system microphone to measure the response of the at least one audio speaker; and a device manager application executable from the computer readable memory and configured to perform the steps of:

calibrating the at least one audio speaker with the measurement microphone using the signals of the signal generator based on the response of the at least one audio speaker thereby creating at least one calibrated audio speaker; and calibrating the at least one system microphone with the at least one calibrated audio speaker using the signals of the signal generator.

2. The system of claim 1 further comprising at least one configuration file accessible by the processor configured to include at least one from the group consisting of a dimensions of an environment value, a noise level value, reverberation value, a deviation of allowance for at least one audio speaker target value, and a deviation of allowance for at least one system microphone target value.

3. The system of claim 2 wherein the device manager application further includes the steps of:

utilizing the measurement microphone to measure at least one impulse response from the signal generator to determine the dimensions of an environment including the at least one system microphone and the at least one audio speaker; and calibrating a dimensions of an environment value of the at least one audio speaker to match the dimensions of the environment value in the configuration file.

4. The system of claim 3 wherein the device manager application further includes the steps of:

instructing the at least one audio speaker to output at least one signal in at least one direction; and calculating the strength of the impulse response and the amount of time for the signal to return within the environment to the measurement microphone.

5. The system of claim 2 wherein the device manager application further includes the steps of:

utilizing the measurement microphone to scan at least one signal for a frequency response and a frequency spike to determine at least one noise level value; and calibrating a gain value of the at least one audio speaker to match the noise level value in the configuration file.

6. The system of claim 2 wherein the device manager application further includes the steps of:

utilizing the measurement microphone to scan at least one signal for a reverberation to determine an amount of echo in the environment; and calibrating a gain value of the at least one audio speaker to match the reverberation value in the configuration file.

7. The system of claim 2 wherein the device manager application further includes the steps of considering a deviation of allowance for at least one audio speaker target value when calibrating the at least one audio speaker.

8. The system of claim 2 wherein the device manager application further includes the steps of considering a deviation of allowance for at least one system microphone target value when calibrating the at least one system microphone.

9. The system of claim 1 wherein the measurement microphone may be fixed in a stationary position embedded into system.

10. A method for automatically calibrating at least one system microphone comprising:

instructing a signal generator to output at least one signal from at least one audio speaker;

measuring the at least one signal from the at least one audio speaker with a measuring microphone;

creating at least one calibrated audio speaker by calibrating a gain of the at least one audio speaker in response to the measuring microphone measuring the at least one signal; and creating at least one calibrated system microphone by calibrating a gain of the at least one system microphone in response to the at least one system microphone measuring the at least one signal from the at least one calibrated audio speaker.

11. The method for automatically calibrating at least one system microphone of claim 10 further comprising performing an initial conformity test on the measurement microphone by examining a calibration history of the at least one audio speaker and the at least one system microphone.

12. The method for automatically calibrating at least one system microphone of claim 11 wherein performing the initial conformity test on the measurement microphone further includes determining whether a number of calibrations and a frequency of calibrations on the at least one audio speaker and the at least one system microphone from the calibration history of the at least one audio speaker and the at least one system microphone exceed a calibration number threshold value and a calibration frequency threshold value.

13. The method for automatically calibrating at least one system microphone of claim 10 further comprising creating at least one noise level values, reverberation values, and dimensions of an environment values from the measurement microphone measuring the at least one signal.

14. The method for automatically calibrating at least one system microphone of claim 13 further comprising calibrating a gain of the at least one audio speaker further in response to at least one from the group consisting of a noise level value, a reverberation value, a dimensions of an environment, and a deviation of allowance for at least one audio speaker target value.

15. The method for automatically calibrating at least one system microphone of claim 13 further comprising calibrating a gain of the at least one system microphone further in response to at least one from the group consisting of a noise level value, a reverberation value, a dimensions of an environment, and a deviation of allowance for at least one system microphone target value.

16. The method for automatically calibrating at least one system microphone of claim 10 further comprising monitoring and calibrating the gain of the at least one audio speaker and the gain of the at least one system microphone in response to the measurement microphone measuring the at least one signal from the at least one audio speaker during a teleconference.

17. A computer-readable program in a computer-readable medium comprising:

a software-based device manager application;

wherein the software-based device manager application is configured to measure at least one sound pressure level for at least one signal produced from at least one audio speaker with a measuring microphone;

wherein the at least one signal is used to create at least one audio speaker measurement value and the software-based device manager application is configured to calibrate the at least one audio speaker with the at least one audio speaker measurement value;

further wherein the software-based device manager application is configured to measure the at least one sound pressure level for at least one signal produced from a calibrated audio speaker with at least one system microphone; and further wherein the software-based device manager application is configured to calibrate the at least one system microphone with at least one system microphone measurement value in response to the at least one signal outputted from the calibrated audio speaker.

18. The computer-readable program in the computer-readable medium of claim 17, wherein the software-based device manager application is configured to access a configuration file and adjust a gain of the at least one audio speaker in response to an audio speaker target value in the configuration file.

19. The computer-readable program in the computer-readable medium of claim 17, wherein the software-based device manager application is configured to access a configuration file and adjust a gain of the at least one system microphone in response to a system microphone target value in the configuration file.

20. The computer-readable program in the computer-readable medium of claim 17, wherein the software-based device manager application is configured to calibrate a gain of the at least one audio speaker and a gain of the at least one system microphone in response to at least one from the group consisting of a size of the environment, a number of audio speakers, a number of system microphones, a number of users, and a position of at least one user.

* * * * *

UNITED STATES PATENT AND TRADEMARK OFFICE

CERTIFICATE OF CORRECTION

PATENT NO. : 8,126,156 B2
APPLICATION NO. : 12/326269
DATED : February 28, 2012
INVENTOR(S) : Tim Corbett et al.

It is certified that error appears in the above-identified patent and that said Letters Patent is hereby corrected as shown below:

In column 12, line 45, in Claim 2, delete "value," and insert -- value, a --, therefor.

Signed and Sealed this
Eighth Day of January, 2013

David J. Kappos

David J. Kappos
*Director of the United States Patent and Trademark Office*